US009863071B2

(12) United States Patent
Cinget et al.

(10) Patent No.: US 9,863,071 B2
(45) Date of Patent: Jan. 9, 2018

(54) KNIT FABRIC FOR USE IN ROOFING MEMBRANES

(71) Applicant: MILLIKEN & COMPANY, Spartanburg, SC (US)

(72) Inventors: Dominique Cinget, Combles (FR); Herve Vaginay, Bapaume (FR); Frederic Pradel, Epehy (FR); Francois Dellieux, Saint Quentin (FR); Jerome Noel, Vermand (FR)

(73) Assignee: Milliken & Company, Spartanburg, SC (US)

( * ) Notice: Subject to any disclaimer, the term of this patent is extended or adjusted under 35 U.S.C. 154(b) by 484 days.

(21) Appl. No.: 14/608,289

(22) Filed: Jan. 29, 2015

(65) Prior Publication Data

US 2016/0222556 A1 Aug. 4, 2016

(51) Int. Cl.

| | |
|---|---|
| ***D04B 21/14*** | (2006.01) |
| ***D04B 21/20*** | (2006.01) |
| ***D06M 15/248*** | (2006.01) |
| ***E04D 5/10*** | (2006.01) |
| *D04B 21/12* | (2006.01) |

(52) U.S. Cl.

CPC ..... *D04B 21/20* (2013.01); *D04B 21/14* (2013.01); *D06M 15/248* (2013.01); *E04D 5/10* (2013.01); *D04B 21/12* (2013.01); *D10B 2403/0122* (2013.01); *D10B 2403/02412* (2013.01); *D10B 2505/18* (2013.01)

(58) Field of Classification Search

CPC ..... D04B 21/14; D04B 21/16; D04B 21/20
USPC ..... 66/190, 192, 195
See application file for complete search history.

(56) References Cited

U.S. PATENT DOCUMENTS

| | | | | |
|---|---|---|---|---|
| 4,615,934 | A * | 10/1986 | Ellison | B29C 70/22 442/1 |
| 5,057,172 | A | 10/1991 | Woiceshyn | 156/148 |
| 5,399,419 | A | 3/1995 | Porter et al. | 428/236 |
| 5,474,838 | A | 12/1995 | Callaway et al. | 428/102 |
| 5,565,259 | A | 10/1996 | Juriga | 428/138 |

(Continued)

FOREIGN PATENT DOCUMENTS

| | | |
|---|---|---|
| EP | 1 132 016 | 9/2001 |
| WO | WO 2013/017327 | 2/2013 |

OTHER PUBLICATIONS

Complete Textile Glossary "Laminated Fabric". Celenese Acetate, New York, NY. 2001.*

(Continued)

*Primary Examiner* — Jenna Johnson
(74) *Attorney, Agent, or Firm* — Cheryl J. Brickey

(57) ABSTRACT

A knit fabric containing a stitch yarn set containing pairs of stitch yarns, a warp yarn set containing in-lay warp yarns, and a weft yarn set containing weft inserted yarns. Each pair of stitch yarns comprises a first stitch yarn and a second stitch yarn, where the first stitch yarn has a two bar first stitch pattern comprising repeating pattern of at least one tricot stitch optionally followed by at least one pillar stitch and the second stitch pattern comprises a mirror image to the first stitch pattern. The first stitch yarn and the second stitch yarn within each pair of stitch yarns are interlinked together, but the first stitch yarn and second stitch yarn of one pair of stitch yarns are not interlinked with first stitch yarn and second stitch yarn of adjacent pairs of stitch yarns.

20 Claims, 7 Drawing Sheets

(56) References Cited

U.S. PATENT DOCUMENTS

| | | | | |
|---|---|---|---|---|
| 7,013,681 | B1 | 3/2006 | Ternon et al. | 66/192 |
| 7,549,303 | B2 | 6/2009 | Callaway et al. | 66/192 |
| 2004/0185734 | A1 | 9/2004 | Gray et al. | 442/312 |
| 2009/0126411 | A1 | 5/2009 | Callaway et al. | 66/192 |

OTHER PUBLICATIONS

Patent Cooperation Treaty PCT International Search Report. dated Feb. 12, 2016, International Application No. PCT/EP2015/078969, International Filing Date, Dec. 8, 2015.

* cited by examiner

KNIT FABRIC FOR USE IN ROOFING MEMBRANES

TECHNICAL FIELD

The present disclosure relates generally to roofing membranes containing a knit fabric.

BACKGROUND

Many membranes, such as membranes used as roofing, contain a fabric layer embedded into a polymer. It has been found that having a thinner fabric layer within the membrane gives certain performance benefits. Thus, there is a need for a thinner a fabric layer.

BRIEF SUMMARY

A knit fabric containing a stitch yarn set containing pairs of stitch yarns, a warp yarn set containing in-lay warp yarns, and a weft yarn set containing weft inserted yarns. Each pair of stitch yarns comprises a first stitch yarn and a second stitch yarn, where the first stitch yarn has a two bar first stitch pattern comprising repeating pattern of at least one tricot stitch optionally followed by at least one pillar stitch and the second stitch pattern comprises a mirror image to the first stitch pattern. The first stitch yarn and the second stitch yarn within each pair of stitch yarns are interlinked together, but the first stitch yarn and second stitch yarn of one pair of stitch yarns are not interlinked with first stitch yarn and second stitch yarn of adjacent pairs of stitch yarns.

BRIEF DESCRIPTION OF THE DRAWING(S)

Exemplary embodiments will now be described by way of example, with reference to the accompanying drawings, wherein.

DETAILED DESCRIPTION

Reference will now be made to the drawings, wherein to the extent possible, like elements are designated by like reference numbers in the various views.

Figure 1:
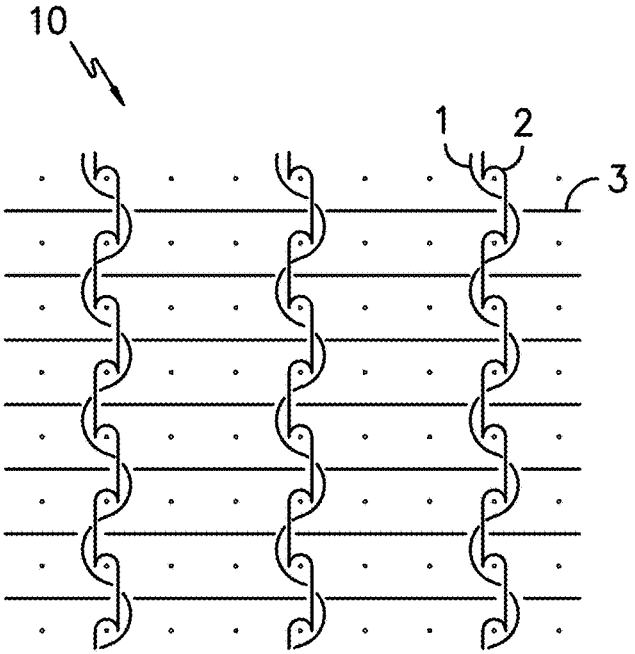
FIG. -1- PRIOR ART
FIGS. 1 and 2 are lapping diagrams of prior art knit fabrics for use in roofing membranes.
Figure 2:
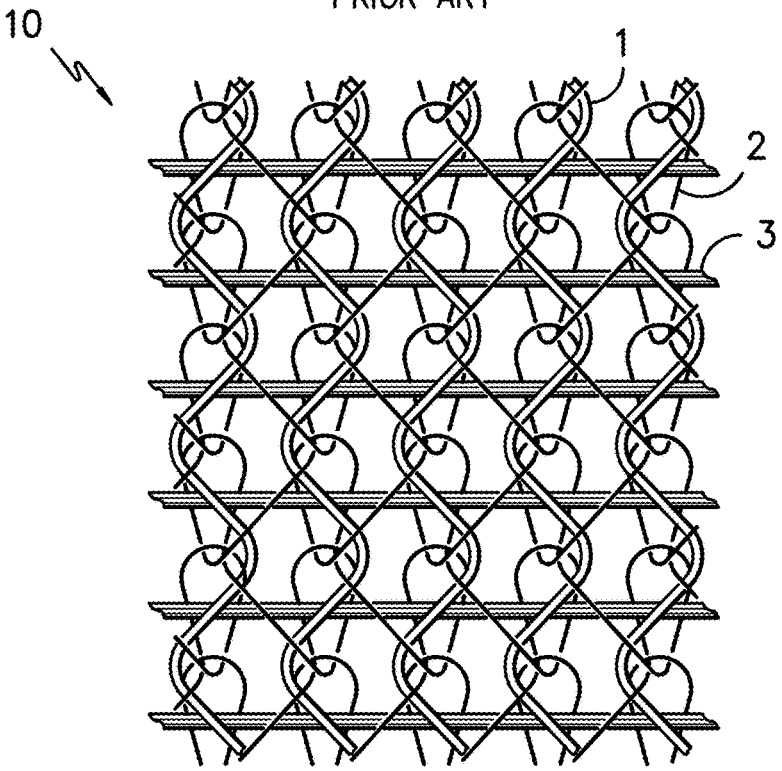
FIG. -2- PRIOR ART
Figure 3:
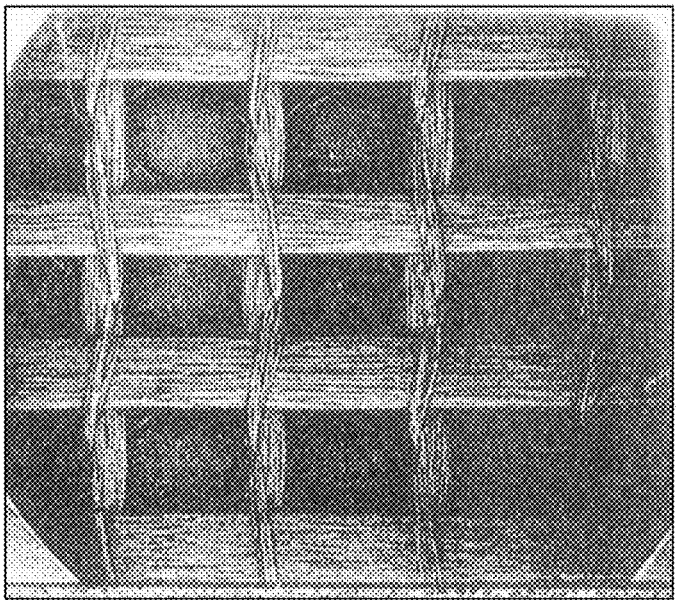
FIG. -3- PRIOR ART
FIG. 3 is a photograph of the knit fabric of FIG. 2.
Figure 4:
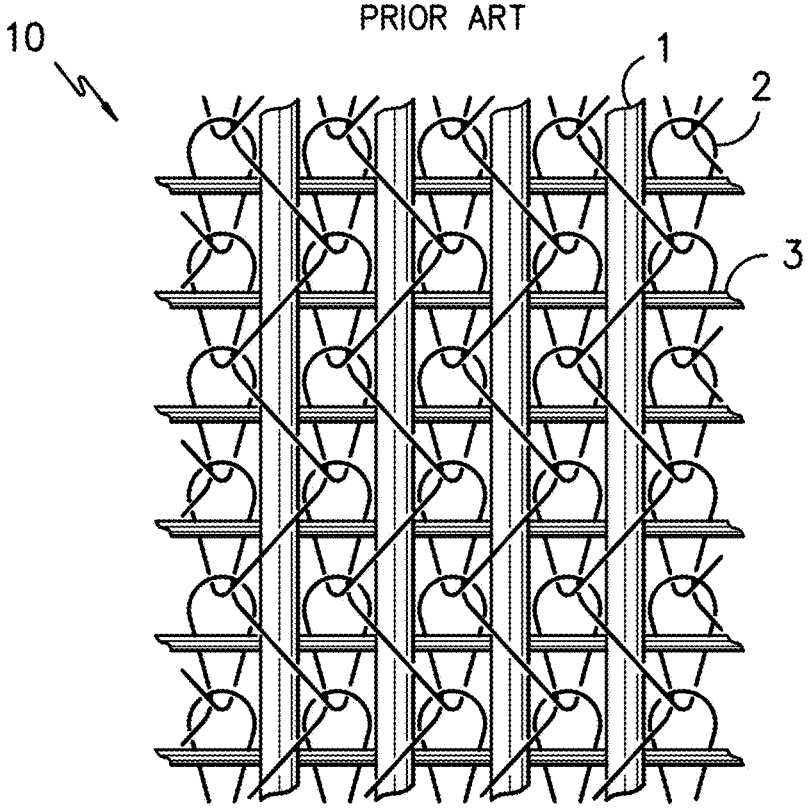
FIG. -4- PRIOR ART
FIG. 4 is lapping diagram of a prior art knit fabrics for use in roofing membranes.
Figure 5:
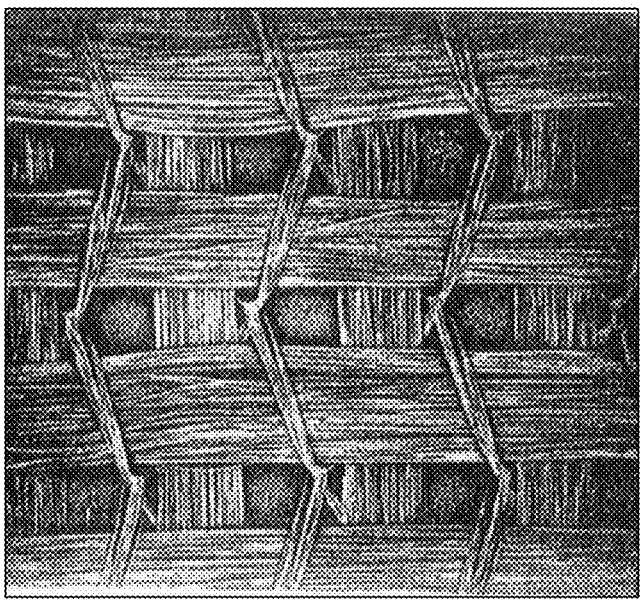
FIG. -5- PRIOR ART
FIG. 5 is a photograph of the knit fabric of FIG. 4.

FIGS. 1-3 illustrate some prior art knit fabrics 10 used for roofing membranes. The knit fabric contains an in-lay warp yarns 1, a stitching yarns 2, and a weft inserted yarns 3. In FIG. 1, the stitching yarns 2 are in a chain stitch configuration and the in-lay warp yarns 1 are in a round stitch configuration. In FIG. 2, the stitching yarns 2 are in a tricot open stitch configuration and the in-lay warp yarns 1 are in a round stitch configuration. FIG. 3 is a photograph of the fabric of FIG. 2. In FIG. 4, the stitching yarns 2 are in a tricot open stitch configuration and the in-lay warp yarns 1 are in a flat stitch configuration. FIG. 5 is a photograph of the fabric of FIG. 4.

In the knit fabrics of FIGS. 1 and 2, the chain stitches of the stitching yarn 2 wrap around the in-lay warp yarn 1 increasing the thickness of the fabric. This can be seen in the photograph of FIG. 3. The knit fabric of FIGS. 1 and 2 may need to be calendared (before or after being embedded into polymer) to become thinner to be more usable in applications such as roofing membranes. Additionally, the knit fabric shown in FIG. 1 tends to have higher elongations than the knit patterns of the invention. How the stitching yarns 2 and the in-lay warp yarns 1 are configured in FIG. 4 results in a fabric where the stitching yarns 2 cross over the open areas formed by the in-lay warp yarns 1 crossing with the weft inserted yarns 3. This can be seen in photograph of the fabric of FIG. 5.

Figure 6:
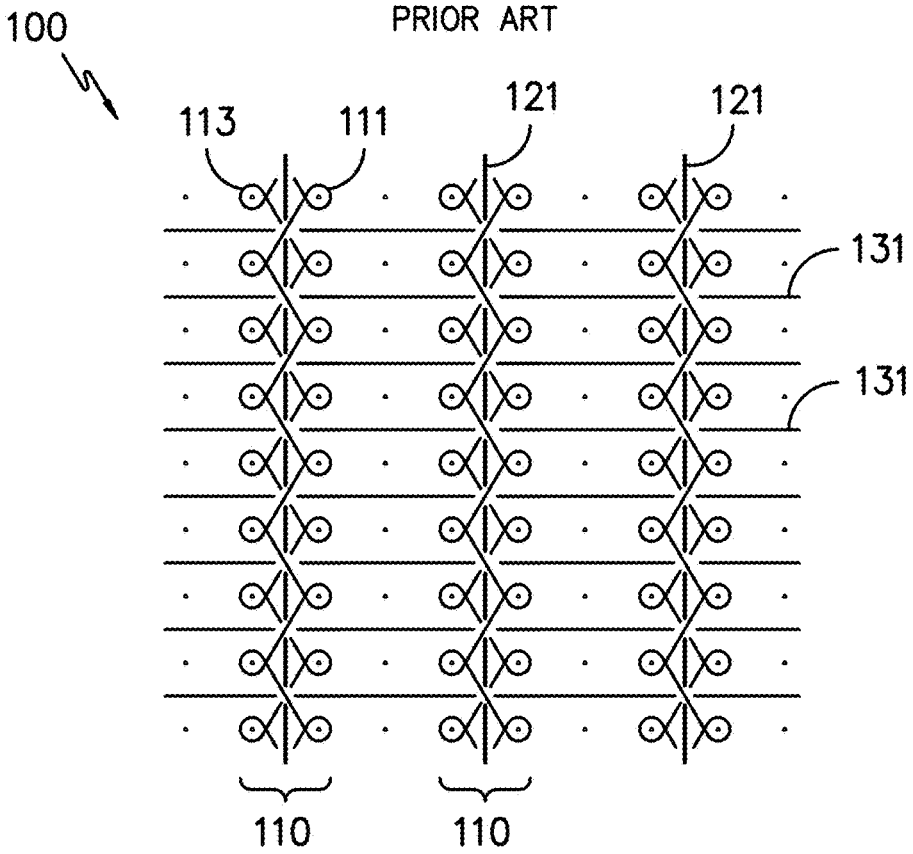
FIG. 6 is a lapping diagram of a two bar knit fabric.
Figure 7:
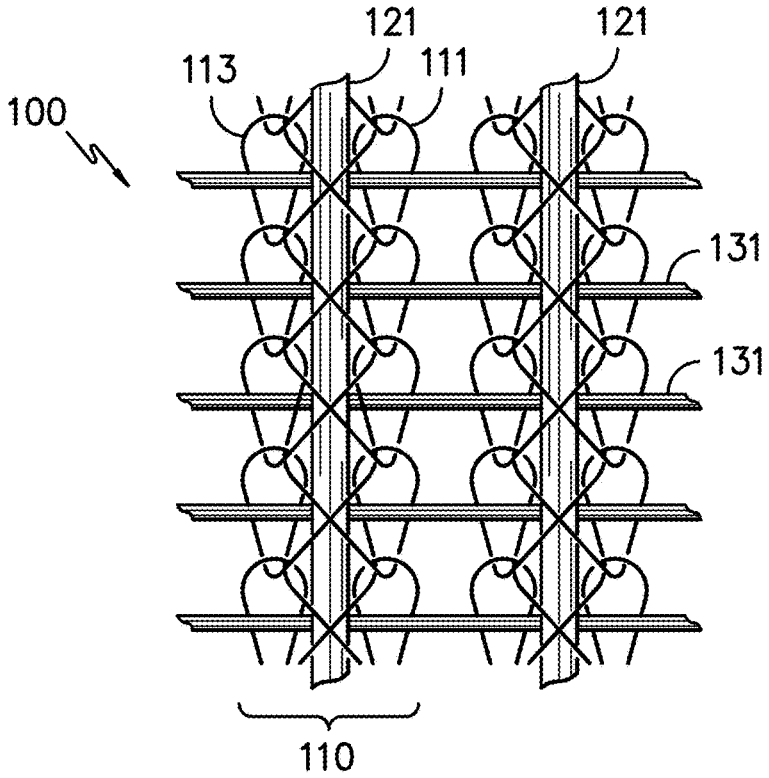
FIG. 7 is an illustration of the two bar knit fabric of FIG. 2.
Figure 8:
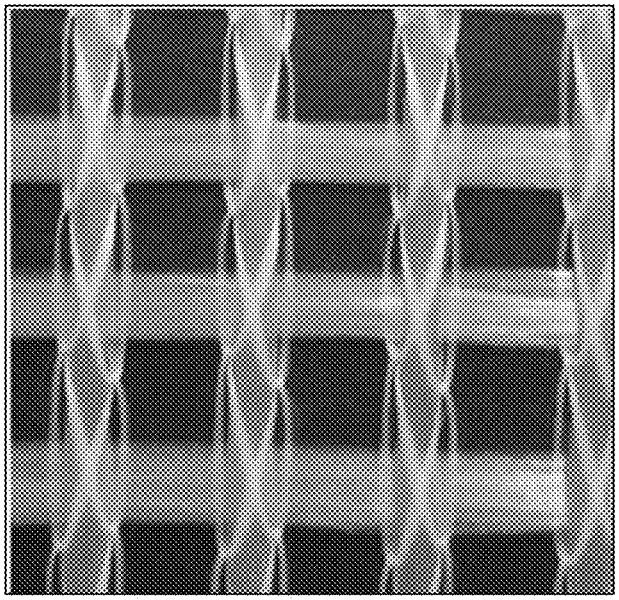
FIG. 8 is a photograph of the two bar knit fabric of FIGS. 2 and 3.

Referring now to FIG. 6, there is shown lapping diagram of a two bar knit fabric 100 having wales and courses. Knitting involves the interlooping or stitching of yarn into vertical columns (wales) and horizontal rows (courses) of loops to form the knitted fabric structure. In warp knitting, the loops are formed along the textile length, i.e., in the wale or warp direction of the textile. The knit of FIG. 6 is thinner and has less elongation than the knits of FIGS. 1 and 2. An illustration of the fabric of FIG. 6 is shown in FIG. 7 and a photograph of the fabric is shown in FIG. 8. The fabric of FIG. 6 is a three bar knit fabric with two of the bars used for the stitching yarns and one of the bars used for the in-lay warp yarns. In contrast, the knit fabric of FIG. 1 would be a two bar knit fabric with one of the bars used for the stitch yarn and one bar used for the in-lay warp yarns.

The knit fabric 100 contains a stitch yarn set, a warp yarn set and a weft yarn set. The stitch yarn set contains pairs of stitch yarns 110, where each pair of stitch yarns 110 contains a first stitch yarn 111 and a second stitch yarn 113. The first stitch yarn 111 has a two bar first stitch pattern comprising repeating pattern of at least one tricot stitch optionally followed by at least one pillar stitch. In FIG. 6, the first stitch yarn 111 has a two bar first stitch pattern comprising a repeating pattern of tricot stitches (and no pillar stitches).

The second stitch yarn 113 has a two bar second stitch pattern which is a mirror image to the first stitch pattern. This means that the second stitch pattern is the same as the first stitch pattern but reversed or mirrored along the warp axis of a warp yarn 121. The stitches of the first stitch yarn 111 and the second stitch yarn 113 are in the same courses and wales. The stitches of the first stitch yarn 111 and the second stitch yarn 113 are in a first wale and a second wale.

Within each pair of stitching yarns 110, the first stitch yarn 111 and the second stitch yarn 113 are interlinked together. Stitching yarn 111 becomes interlinked with stitch yarn 113 after it has moves from its needles column to the needle column of yarn 113 (underlaps), the two yarns (111 & 113 become interlinked because they are stitching on the same needle. Stitching yarns 111, 113 within one pair of stitching yarns 110 are not interlinked with the stitching yarns 111, 113 from other pairs of stitching yarns 110. The first stitch yarn 111 and the second stitch yarn 113 of one pair of stitch yarns 110 are not interlinked with the first stitch yarn 111 and the second stitch yarn 113 of adjacent pairs of stitch yarns 110. An adjacent pair of stitch yarns, in this application, means the pair of stitch yarns nearest to the original pair of stitch yarns. Pairs of stitching yarns are adjacent if they do not have another set of stitching yarns between them. The pairs of stitching yarns do not have to be touching or right next to one another, they may be several wales away and even up to an inch or many inches away from one another.

Figure 9:
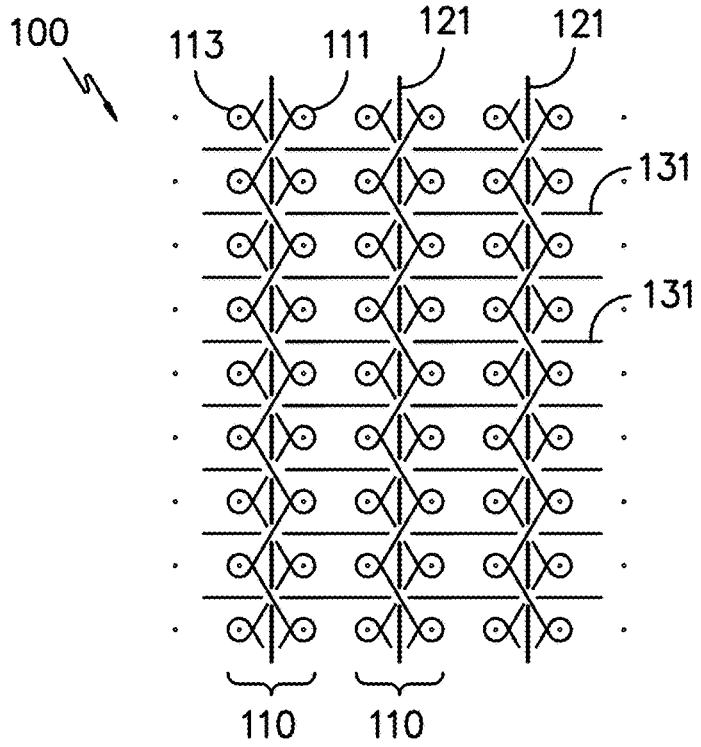
FIGS. 9 and 10 are lapping diagrams of additional two bar knit fabrics.

In one embodiment, two adjacent pairs of stitching yarns 110 are separated by a space having a width defined to be the distance between the first wale and the second wale of the first stitch pattern. This configuration may be seen in FIG. 9.

Figure 10:
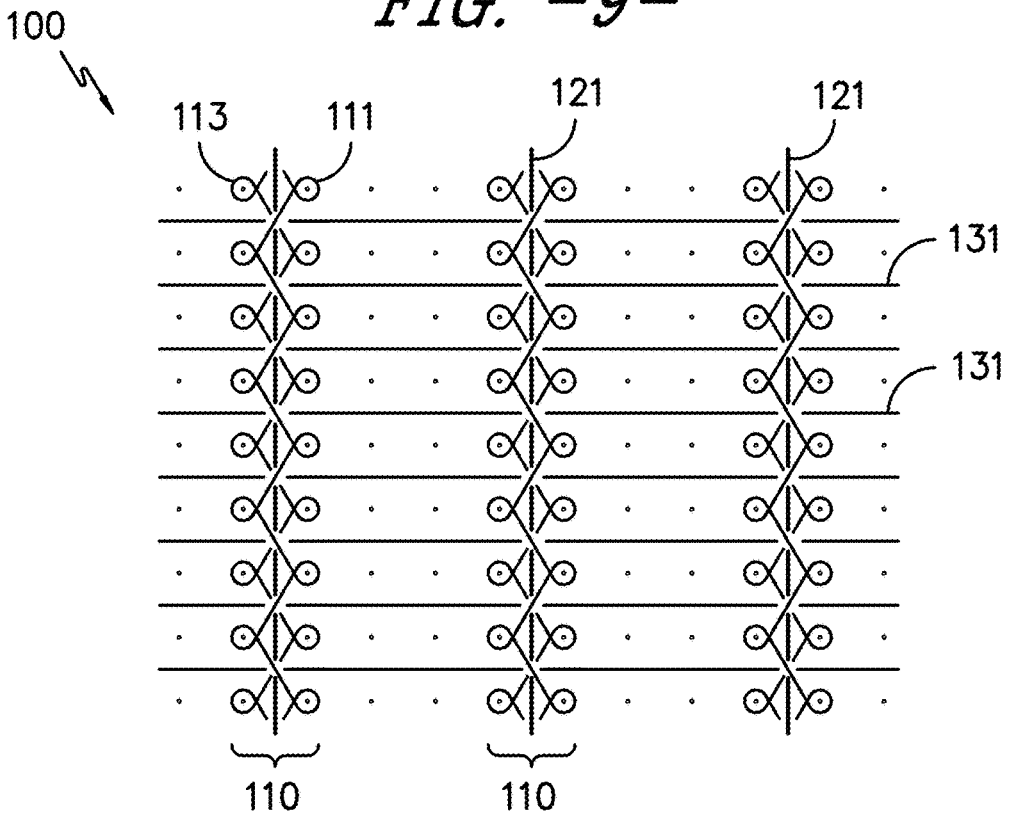

In another embodiment shown in FIG. 6, two adjacent pairs of stitch yarns 110 are separate by a space having a width defined to be about twice the distance between the first wale and the second wale of the first stitch pattern. In another embodiment shown in FIG. 10, two adjacent pairs of stitch yarns 110 are separate by a space having a width defined to be about three times the distance between the first wale and the second wale of the first stitch pattern.

In another embodiment, two adjacent pairs of stitch yarns 110 are separate by a space having a width defined to be at least about four times the distance between the first wale and the second wale of the first stitch pattern. In another embodiment, two adjacent pairs of stitch yarns 110 are separate by a distance of at least about 0.25 inches. In another embodiment, two adjacent pairs of stitch yarns 110 are separate by a distance of at least about 0.5 inches, more preferably at least about 1 inch. In another embodiment, two adjacent pairs of stitch yarns 110 are separate by a distance of at least about 3 inches, more preferably at least about 5 inches. How large the distance between the pairs of stitch yarns 110 controls how open the fabric is (how much of the surface area of the fabric is open or without any yarns). The spacing of the pairs of stitch yarns 110 is determined by the desired properties of the knit fabric and its end use.

The first stitch yarn 111 has a two bar first stitch pattern comprising repeating pattern of at least one tricot stitch optionally followed by at least one pillar stitch. In one embodiment, the pattern contains only tricot stitches. In another embodiment, the pattern contains a repeating pattern of 1 tricot stitch followed by a chain stitch. In another embodiment, the pattern contains a repeating pattern of 2 tricot stitches followed by 2 chain stitches or a repeating pattern of 2 tricot stitches followed by 1 chain stitch. Other possible patterns include (but are not limited to) repeating patterns of 3 tricot stitches followed by 2 chain stitches, 4 tricot stitches followed by 2 chain stitches, 3 tricot stitches followed by 3 chain stitches, and 5 tricot stitches followed by 2 chain stitches. In another embodiment, the pattern comprises a repeating pattern of at least 1 tricot stitch followed by at least 1 chain stitch. In this embodiment, the pattern does not necessarily have the same number of tricot stitches and chain stitches repeated over and over again, but may have a pattern such as 1 tricot stitch, 1 chain stitch, 3 tricot stitches, 2 chain stitches, 4 tricot stitches, 1 chain stitch, etc. In another embodiment, the number of tricot stitches followed by the number of chain stitches is random and not in a defined pattern. In another embodiment, the pattern contains a repeating pattern of a large number (greater than 10) tricot stitches followed by at least 1 chain stitch. The percentage by number of tricot stitches and china stitches in the pattern is dictated by the desired end result. Additionally, how the tricot or chain stitches are grouped together (the number of the same type of stitches in a row) is also dictated by the desired end result. The first stitch pattern and the second stitch pattern may also contain any other suitable stitch within the pattern.

Figure 11:
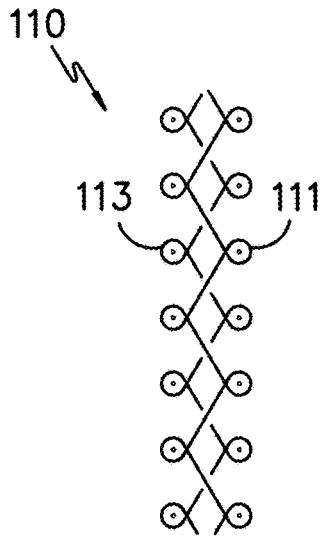
FIGS. 11-16 are lapping diagrams of the pairs of stitching yarns.
Figure 12:
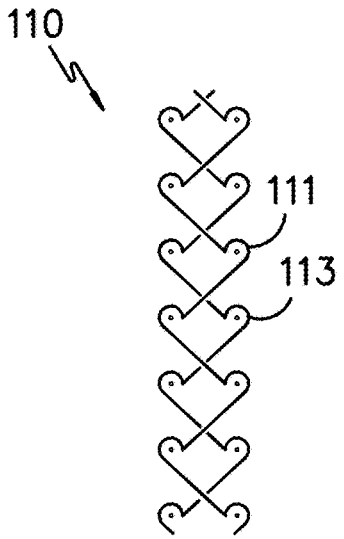

FIG. 11 illustrates one embodiment of the lapping pattern of the stitching yarns 111, 113 where the first stitching pattern comprises a repeating pattern of tricot stitches with a closed stitch and the second stitching pattern comprise a mirror of the first stitching pattern. FIG. 12 illustrates one embodiment of the lapping pattern of the stitching yarns 111, 113 where the first stitching pattern comprises a repeating pattern of tricot stitches with an open stitch and the second stitching pattern comprise a mirror of the first stitching pattern.

Figure 13:
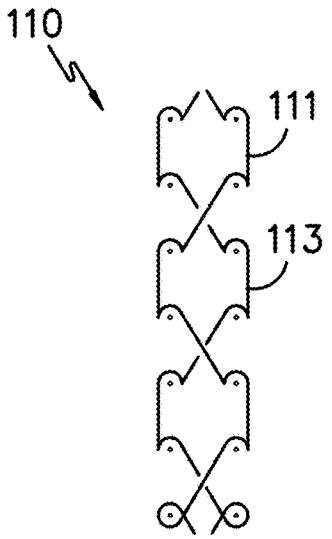

FIG. 13 illustrates one embodiment of the lapping pattern of the stitching yarns 111, 113 where the first stitching pattern comprises a repeating pattern of 1 tricot stitches followed by 2 pillar stitches with a mixture of closed and open stitches and the second stitching pattern comprise a mirror of the first stitching pattern.

Figure 14:
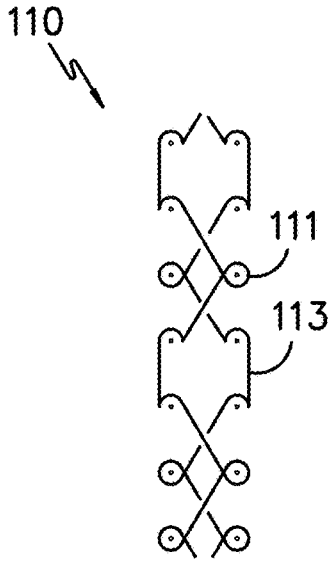

FIG. 14 illustrates one embodiment of the lapping pattern of the stitching yarns 111, 113 where the first stitching pattern comprises a repeating pattern of 2 tricot stitches followed by 2 pillar stitches with a mixture of closed and open stitches and the second stitching pattern comprise a mirror of the first stitching pattern.

Figure 15:
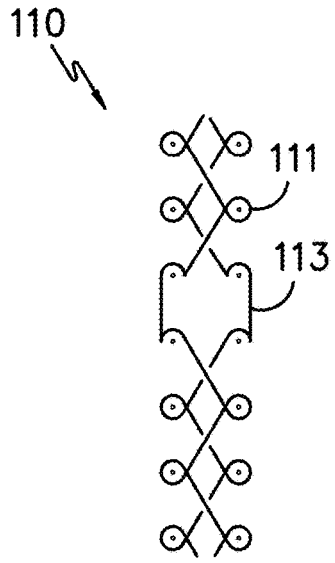

FIG. 15 illustrates one embodiment of the lapping pattern of the stitching yarns 111, 113 where the first stitching pattern comprises a repeating pattern of 3 tricot stitches followed by 2 pillar stitches with a mixture of closed and open stitches and the second stitching pattern comprise a mirror of the first stitching pattern.

Figure 16:
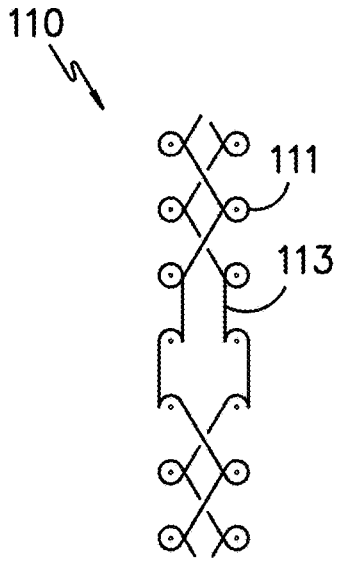

FIG. 16 illustrates one embodiment of the lapping pattern of the stitching yarns 111, 113 where the first stitching pattern comprises a repeating pattern of 2 tricot stitches followed by 3 pillar stitches with a mixture of closed and open stitches and the second stitching pattern comprise a mirror of the first stitching pattern.

Referring back to the knit fabric 100 of FIG. 6, the fabric also contains a warp yarn set comprising in-lay warp yarns 121 located between the first wale and second wale of at least a portion of the pairs of stitch yarns 110. In a preferred embodiment, the lay warp yarns 121 are located between the first wale and second wale of each pair of stitch yarns 110. The in-lay warp yarn 110 is inserted such that it lays between the two columns (two wales) of stitches formed by the pair of stitch yarns 110. The illustration of FIG. 7 and the photograph of FIG. 8 illustrate the position of the in-lay warp yarn 120 to the first and second stitching yarns 111, 113. The stitches from the stitching yarns 111, 113 form on the sides of the in-lay warp yarns 120 versus some prior art knit patterns where the stitches would lay on the warp yarns 120. This enables a thinner knit fabric 100.

Because the stitches formed by the stitching yarns 111, 113 are on the sides of the in-lay warp yarns 121, the knit fabric of the invention is thinner than some prior art knits such as shown in FIGS. 1 and 2. Preferably, the knit fabric has a thickness of between about 0.2 to 0.5 mm, more preferably between about 0.25 and 0.45 mm, more preferably between about 0.28 and 0.32 mm. This enables the knit fabric to be used without calendaring in a roofing membrane which saves a costly manufacturing step.

The knit fabric of FIG. 6 also contains a weft yarn set. The weft yarn set contains weft inserted yarns 131 which are inserted in at least a portion of the courses in the fabric 100. Preferably, the weft inserted yarns are inserted into courses between the stitches of the stitching yarns 111, 113. The weft inserted yarns can also be seen in FIGS. 7 and 8.

The stitches by the first stitching yarn 111 and the second stitching yarn 113 within the knit fabric may be open loops and/or closed loops. As used herein, open loops refer to interlacing yarns where a front or a back yarn does not cross over itself in forming the loop. Also, as used herein, closed loops refer to interlacing yarns where a front or a back yarn crosses over itself in forming the loop. In one embodiment, the knit fabric is an open loop construction meaning that the stitches are open. This construction is sometimes preferred as it may produce the lightest weight and most open knit fabric. In another embodiment, the knit fabric is a closed loop construction meaning that the stitches are closed. In one embodiment, the stitches of the knit fabric are closed. In another embodiment, the turning stitches of the knit fabric are open. In another embodiment, the stitches in the knit fabric may be a mixture of open and closed. In one embodiment in the knit fabric, the movement between stitches is an underlap movement, and in other embodiments, the movement between stitches is an overlap movement.

The yarns used in the knit fabric may be any suitable yarn, including but not limited to a spun staple yarn, a multifilament yarn, and/or a monofilament yarn and are formed of a material which will restrain the belt plies 230. "Yarn", in this application, as used herein includes a monofilament elongated body, a multifilament elongated body, ribbon, strip, fiber, tape, and the like. The term yarn includes a plurality of any one or combination of the above. Some suitable materials for the yarns include polyamide, aramids (including meta and para forms), rayon, PVA (polyvinyl alcohol), polyester, polyolefin, polyvinyl, nylon (including nylon 6, nylon 6, 6, and nylon 4, 6), polyethylene naphthalate (PEN), cotton, steel, carbon, fiberglass, steel, polyacrylic or any other suitable artificial or natural fiber. In one embodiment, the yarns are preferably rayon, polyester or nylon.

In one embodiment, the yarns may be single monofilament or multifilaments yarns (twisted and/or cabled cords) made with any of the prior listed materials, also including hybrid yarns, or film-tape yarns.

In one embodiment, the yarns may be hybrid yarns. These hybrid yarns are made up of at least 2 fibers of different fiber material (for example, cotton and nylon). These different fiber materials can produce hybrid yarns with different chemical and physical properties. Hybrid yarns are able to change the physical properties of the final product they are used in. Some preferred hybrid yarns include an aramid fiber with a nylon fiber, an aramid fiber with a rayon fiber, and an aramid fiber with a polyester fiber.

In one preferred embodiment, the stitching yarns 111, 113 comprise PA, PET, PE, PP multifilament or monofil from 22 dtex to 280 dtex, the warp yarns 120 comprise PA, PET, PE, PP multifilament or monofilament from 80 dtex to 6600 dtex, and the weft yarns 130 comprise PA, PET, PE, PP multifilament or monofilament from 80 dtex to 6600 dtex.

The knit fabric may be treated with any suitable composition and the treatment may be applied to the yarns before knitting or to the knit fabric. Some treatments may include adhesion promoters, anti-wicking chemistries, colorants, anti-microbial chemistries, abrasion resistance, UV stabilizers, and the like.

The knit fabric may be used in any suitable product such as roofing, tires, concrete reinforcement, as house wrap. It is particularly advantageous to use in applications where a thinner reinforcement is desired. The knit fabric may be used without calendaring due to its construction, but may also be calendared to further reduce its thickness.

Figure 17:
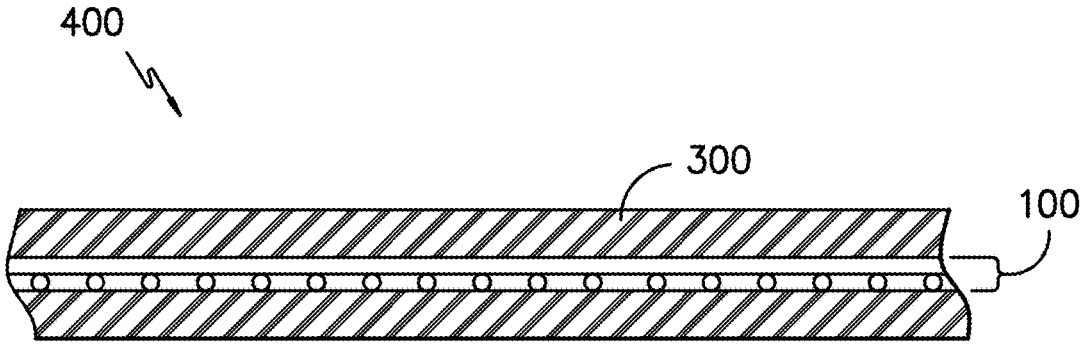
FIG. 17 is a schematic illustration of a membrane containing a two bar knit fabric.

In one embodiment shown in FIG. 17, the knit fabric 100 of the invention is at least partially embedded into a polymer to form a membrane 400 (such as for a roofing membrane). Preferably, the fabric is fully embedded into the polymer 300. The polymer 300 may be any suitable polymer and its selection is dependent on the desired properties of the finished membrane. In one embodiment, the polymer 300 contains polyvinyl chloride (PVC). In another embodiment, the polymer 300 contains a thermoplastic olefin (TPO). These polymers have been found to produce roofing membrane with good properties and cost effectiveness. In one embodiment, the polymer layer(s) 130 have a thickness of between about 0.5 and 10 mm, more preferably between about 1 and 5 mm, more preferably between about 1.2 and 2.2 mm.

The polymer 300 may be applied to the knit fabric 100 in any suitable manner such as coating, extruding, and lamination. In one preferred embodiment, the polymer 300 is laminated onto the knit fabric 100. A polymer 300 is delivered to the knit fabric 100 as a free standing film that is then adhered to the fabric 100 using heat and/or pressure and/or adhesive. The polymer 300 may be applied to only one side of the knit fabric 100 or may be applied to both sides of the knit fabric sequentially or simultaneously.

In another preferred embodiment, the polymer 300 is extruded onto the knit fabric 100. A polymer 300 is delivered to the knit fabric 100 in a molten state on one or both sides of the fabric 100.

The membrane 400 may be subjected to additional processing steps such as coatings, surface treatments, adhering the membrane to additional components, and calendaring. Calendaring further compresses the polymer 300 and the fabric 100 to deliver a thinner membrane 400. Calendaring may be part of the process of coating the knit fabric 100 with the polymer 300 such as in the lamination process or a separate operation.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A knit fabric having wales and courses comprising:

a stitch yarn set comprising pairs of stitch yarns, wherein each pair of stitch yarns comprises a first stitch yarn and a second stitch yarn, wherein the first stitch yarn has a two bar first stitch pattern consisting of a repeating pattern of at least one tricot stitch optionally followed by at least one pillar stitch, wherein the stitches of the first stitch pattern are located in a first wale and a second wale of the fabric, wherein the second stitch yarn has a two bar second stitch pattern, wherein the second stitch pattern is a mirror image to the first stitch pattern, and wherein the stitches of the second stitch pattern are located in the first wale and the second wale of the fabric;

wherein the first stitch yarn and the second stitch yarn within each pair of stitch yarns are interlinked together, and wherein the first stitch yarn and second stitch yarn of one pair of stitch yarns are not interlinked with first stitch yarn and second stitch yarn of adjacent pairs of stitch yarns;

a warp yarn set comprising in-lay warp yarns located between the first wale and second wale of at least a portion of the pairs of stitch yarns; and, a weft yarn set comprising weft inserted yarns, wherein the weft inserted yarns are inserted in at least a portion of the courses of the fabric.

2. The knit fabric of claim 1, wherein two adjacent pairs of stitch yarns are separated by a space having a width defined to be the distance between the first wale and the second wale of the first stitch pattern.

3. The knit fabric of claim 1, wherein two adjacent pairs of stitch yarns are separated by a space having a width defined to be twice the distance between the first wale and the second wale of the first stitch pattern.

4. The knit fabric of claim 1, wherein two adjacent pairs of stitch yarns are separated by a space having a width defined to be at least four times the distance between the first wale and the second wale of the first stitch pattern.

5. The knit fabric of claim 1, wherein the two bar first stitch pattern consists of a repeating pattern of tricot stitches.

6. The knit fabric of claim 1, wherein the two bar first stitch pattern consists of a repeating pattern one tricot stitch followed by one pillar stitch.

7. The knit fabric of claim 1, wherein the two bar first stitch pattern consists of a repeating pattern two tricot stitches followed by two pillar stitches.

8. The knit fabric of claim 1, wherein the two bar first stitch pattern consists of a repeating pattern three tricot stitches followed by two pillar stitches.

9. The knit fabric of claim 1, wherein the knit fabric is calendared.

10. The knit fabric of claim 1, wherein the knit fabric is at least partially embedded into a polymer.

11. The knit fabric of claim 10, wherein the polymer is polyvinyl chloride.

12. A membrane comprising a knit fabric having wales and courses at least partially embedded into a polymer, wherein the knit fabric comprises:

a stitch yarn set comprising pairs of stitch yarns, wherein each pair of stitch yarns comprises a first stitch yarn and a second stitch yarn, wherein the first stitch yarn has a two bar first stitch pattern consisting of a repeating pattern of at least one tricot stitch optionally followed by at least one pillar stitch, wherein the stitches of the first stitch pattern are located in a first wale and a second wale of the fabric, wherein the second stitch yarn has a two bar second stitch pattern, wherein the second stitch pattern is a mirror image to the first stitch pattern, and wherein the stitches of the second stitch pattern are located in the first wale and the second wale of the fabric;

wherein the first stitch yarn and the second stitch yarn within each pair of stitch yarns are interlinked together, and wherein the first stitch yarn and second stitch yarn of one pair of stitch yarns are not interlinked with first stitch yarn and second stitch yarn of adjacent pairs of stitch yarns;

a warp yarn set comprising in-lay warp yarns located between the first wale and second wale of at least a portion of the pairs of stitch yarns; and, a weft yarn set comprising weft inserted yarns, wherein the weft inserted yarns are inserted in the courses of the fabric.

13. The membrane of claim 12, wherein the knit fabric is fully embedded in the polymer.

14. The membrane of claim 12, wherein two adjacent pairs of stitch yarns are separated by a space having a width defined to be about the distance between the first wale and the second wale of the first stitch pattern.

15. The membrane of claim 12, wherein two adjacent pairs of stitch yarns are separated by a space having a width defined to be at least about two times the distance between the first wale and the second wale of the first stitch pattern.

16. The membrane of claim 12, wherein the two bar first stitch pattern consists of a repeating pattern of tricot stitches.

17. The membrane of claim 12, wherein the two bar first stitch pattern consists of a repeating pattern one tricot stitch followed by one pillar stitch.

18. The membrane of claim 12, wherein the two bar first stitch pattern consists of a repeating pattern two tricot stitches followed by two pillar stitches.

19. The membrane of claim 12, wherein the knit fabric is calendared.

20. The membrane of claim 12, wherein the polymer is polyvinyl chloride.

* * * * *